US011700912B2

(12) United States Patent
Lilley

(10) Patent No.: US 11,700,912 B2
(45) Date of Patent: Jul. 18, 2023

(54) ITEM OF FOOTWEAR

(71) Applicant: FITFLOP LIMITED, London (GB)

(72) Inventor: Kim Lilley, London (GB)

(73) Assignee: FITFLOP LIMITED, London (GB)

( * ) Notice: Subject to any disclaimer, the term of this patent is extended or adjusted under 35 U.S.C. 154(b) by 114 days.

(21) Appl. No.: 15/780,017

(22) PCT Filed: Nov. 24, 2016

(86) PCT No.: PCT/GB2016/053692
§ 371 (c)(1),
(2) Date: May 30, 2018

(87) PCT Pub. No.: WO2017/093713
PCT Pub. Date: Jun. 8, 2017

(65) Prior Publication Data

US 2018/0368517 A1 Dec. 27, 2018

(30) Foreign Application Priority Data

Dec. 1, 2015 (GB) ..... 1521197

(51) Int. Cl.
*A43B 13/14* (2006.01)
*A43B 3/00* (2022.01)
(Continued)

(52) U.S. Cl.
CPC ..... *A43B 13/141* (2013.01); *A43B 3/0042* (2013.01); *A43B 3/0057* (2013.01);
(Continued)

(58) Field of Classification Search
CPC ..... A43B 3/0042; A43B 3/0057; A43B 13/12; A43B 13/125; A43B 13/141; A43B 13/223; A43B 3/0063; A43B 13/04
See application file for complete search history.

(56) References Cited

U.S. PATENT DOCUMENTS 500,385 A * 6/1893 Hall ..... A43B 13/141 36/102
4,060,917 A * 12/1977 Canale ..... A43B 13/223 36/59 C
(Continued)

FOREIGN PATENT DOCUMENTS

CN 201557631 U 8/2010
CN 202873956 U 4/2013
(Continued)

OTHER PUBLICATIONS

International Search Report and Written Opinion for PCT/GB2016/053692, dated Jun. 8, 2017, 10 pages.
(Continued)

*Primary Examiner* — Jocelyn Bravo
(74) *Attorney, Agent, or Firm* — Luedeka Neely Group, PC; Robert O. Fox

(57) ABSTRACT

The invention relates to an item of footwear in which is provided a mid-sole (10) with features that provide comfort to the wearer when walking. An item of footwear comprising: a sole (1) comprising a mid-sole (10), the mid-sole having a first major surface (11) for facing the foot of a wearer, a second major surface (12) opposite the first, the mid-sole (10) having an inner edge (13) corresponding to the inside of a wearer's foot and an outer edge (14) corresponding to the outside of a wearer's foot; and a securing means for securing the item of footwear to a foot of a wearer such that the first surface (11) of the sole (1) contacts the foot, wherein: the mid-sole (10) has formed therein a plurality of generally transverse grooves (20) and a generally longitudinal primary groove (30*a*), thereby dividing the sole (1) into an array of lands (50); and the primary groove (30*a*) is substantially parallel to the outer edge (14) of the sole (1)
(Continued)

over a majority of the length of the sole (1) and defines with 15 the transverse grooves (20) a plurality of lands (50).

23 Claims, 3 Drawing Sheets

(51) Int. Cl.
*A43B 13/04* (2006.01)
*A43B 13/12* (2006.01)

(52) U.S. Cl.
CPC ..... *A43B 3/0063* (2013.01); *A43B 13/04* (2013.01); *A43B 13/12* (2013.01)

(56) References Cited

U.S. PATENT DOCUMENTS 4,897,936 A * 2/1990 Fuerst ..... A43B 13/12 36/114
5,012,597 A * 5/1991 Thomasson ..... A43B 13/143 36/114
D468,082 S * 1/2003 Brown ..... D2/955
D547,933 S 8/2007 Loverin
7,513,064 B2 * 4/2009 Fuerst ..... A43B 1/14 36/102
D605,838 S * 12/2009 Foust ..... D2/951
D621,146 S * 8/2010 McClaskie ..... D2/957
8,256,146 B2 * 9/2012 Loverin ..... A43B 3/30 36/102
2002/0144429 A1 * 10/2002 Hay ..... A43B 7/1425 36/25 R
2005/0178024 A1 * 8/2005 Hauglin ..... A43B 13/141 36/25 R
2007/0199213 A1 * 8/2007 Campbell ..... A43B 13/141 36/102
2008/0127523 A1 * 6/2008 Hauglin ..... A43B 13/12 36/117.2
2008/0229617 A1 * 9/2008 Johnson ..... A43B 3/0057 36/102
2010/0299965 A1 12/2010 Avar et al.
2012/0174433 A1 * 7/2012 Mahoney ..... A43B 7/1425 36/28
2012/0174439 A1 7/2012 O'Connor
2013/0000152 A1 1/2013 Cooper et al.
2013/0055596 A1 * 3/2013 Wan ..... A43B 13/141 36/25 R
2014/0041261 A1 * 2/2014 Walker ..... A43B 13/181 36/25 R
2014/0150297 A1 * 6/2014 Holmes ..... A43B 13/125 36/103
2014/0259744 A1 * 9/2014 Cooper ..... A43B 13/141 36/28
2018/0092432 A1 * 4/2018 Hoffer ..... A43B 13/125

FOREIGN PATENT DOCUMENTS

CN 203723518 U 7/2014
CN 204519518 U 8/2015
DE 3005077 A1 8/1981
GB 2487367 A 7/2012
JP 3150974 U 6/2009
KR 101278175 B1 6/2013
WO 2009134598 A3 2/2012

OTHER PUBLICATIONS

European Patent Office Examination Report for EP App. No. 16804866.8, dated Dec. 1, 2021, 5 pages.

* cited by examiner

ITEM OF FOOTWEAR

The invention relates to an item of footwear in which is provided a mid-sole with features that provide comfort to the wearer when walking.

It is known to provide grooves in the soles of footwear to increase the flexibility thereof. Such footwear is generally designed for sporting use and not for comfort. There is therefore a need to provide comfortable footwear designed for everyday usage.

Accordingly, there is provided an item of footwear as defined by the appended claims.

For a better understanding of the invention and to show how the same may be put into effect, reference will now be made, by way of example only, to the accompanying drawings in which:

FIG. 1 shows an embodiment of an item of footwear in accordance with the invention.

Figure 1:
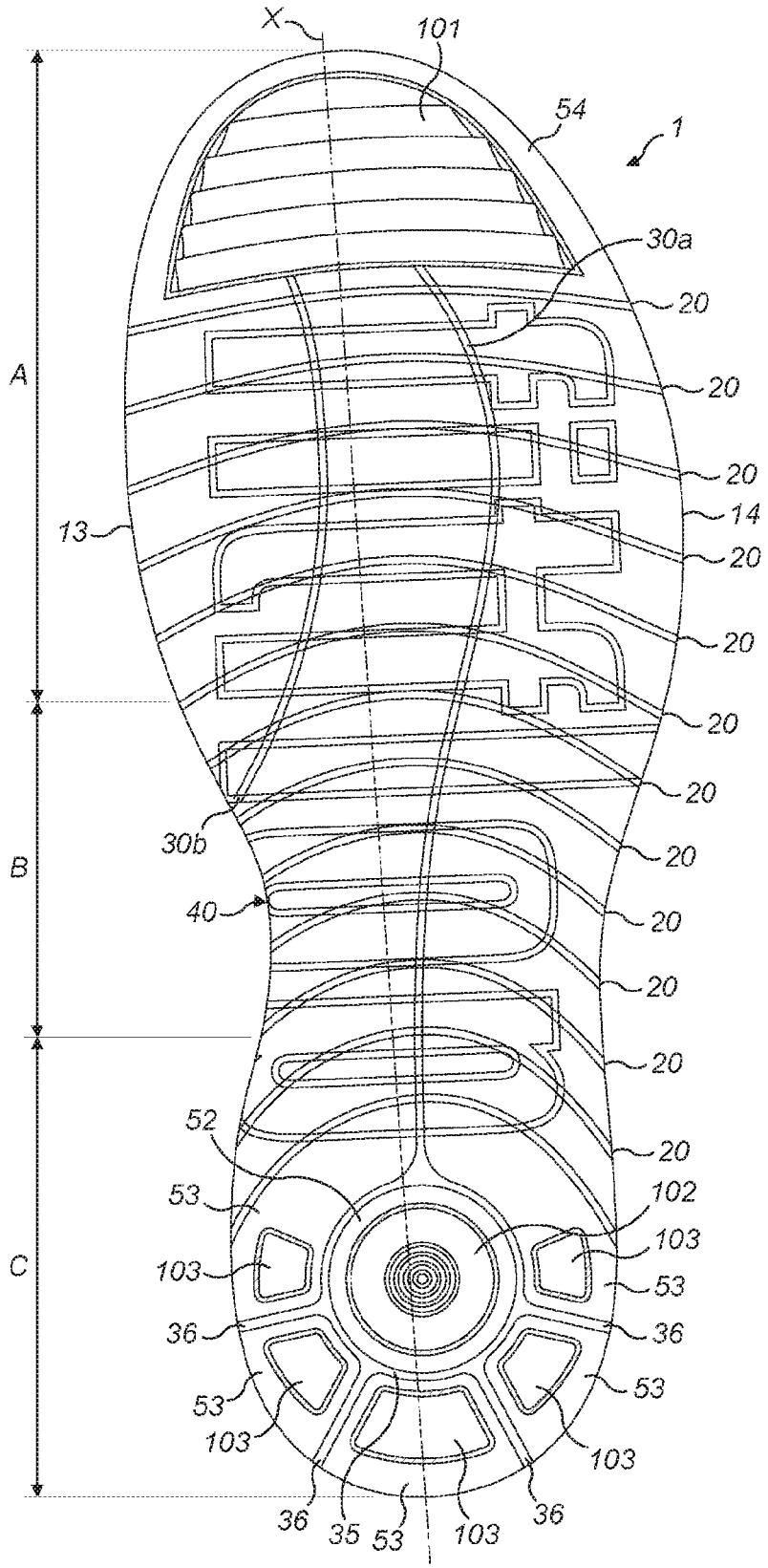
FIG. 1 shows the underside of an item of footwear in accordance with the present invention.

The item of footwear comprises a sole 1. The sole 1 comprises a mid-sole 10. The mid-sole 10 comprises or is formed from: ethylene vinyl acetate (EVA) and/or expanded foam (such as biodegradable expanded foam).

An optional outsole 40 may be provided. The outsole 40 may comprise or be formed from: rubber. As can be seen from FIG. 1, the outsole 40 may be textured (in addition to the grooves described below) to provide additional grip.

The mid-sole has a first major surface 11 for facing the foot of a wearer and a second major surface 12 opposite the first 11 facing away from the foot of the wearer. The mid-sole 10 has an inner edge 13 corresponding to the inside of a wearer's foot and an outer edge 14 corresponding to the outside of a wearer's foot.

The mid-sole 10 includes a forefoot region A arranged to support the forefoot of a wearer of the item of footwear. The forefoot region A extends over the forwardmost 15% to 24% of the length of the mid-sole 10. The mid-sole 10 includes an arch region B arranged to support the arch of the foot of a wearer of the item of footwear. The mid-sole 10 includes a heel region C arranged to support the heel of a wearer of the item of footwear. The heel region C extends over the rearmost 29% to 39% of the length of the mid-sole 10. The arch region B extends from the forefoot region A to the heel region C.

The item of footwear comprises a securing means (not shown) for securing the item of footwear to a foot of a wearer (for example, the securing means may be a strap such as in an open shoe, or an upper, if the item of footwear is a closed shoe). When in use the first major surface of the sole supports the user's foot. The first major surface of the midsole 10 can contact the user's foot directly or an insole can be interposed between the midsole 10 and the user's foot. The term midsole used in the specification should be understood to refer to a component which is: sandwiched between an insole and an outsole, or contacts the user's foot directly and is provided with an outsole; or is used in a shoe without an insole or outside and provides itself the contact surface for a user's foot and the ground.

A plurality of generally transverse grooves 20 are formed in the mid-sole 10. The transverse direction extends from the inside edge 13 to the outside edge 14, perpendicular to the longitudinal direction of the item of footwear. Preferably, the plurality of generally transverse grooves 20 each extend from the inside edge 13 to the outside edge 14.

The plurality of generally transverse grooves 20 are preferably substantially arc-shaped. That is, the transverse grooves 20 are curved such that their midpoints are further forward on the midsole 10 than their outermost extents.

The radius of curvature of the plurality of generally transverse grooves 20 increases with increasing distance from the rearmost point of the mid-sole 10. In this way, the transverse grooves 20 near the heel of the item of footwear have a smaller radius of curvature (they are more curved) than the transverse grooves 20 near the frontal end of the item of footwear.

Each of the plurality of generally transverse grooves 20 is spaced from its nearest neighbour by a distance in the range 8 mm to 14 mm.

The mid-sole 10 comprises a generally longitudinal primary groove 30*a*. The generally longitudinal primary groove 30*a* extends over at least 50% of the length of the midsole 10 in the longitudinal direction X, and preferably at least 70%. The longitudinal direction X extends from the rearmost point of the heel of the item of footwear to the forwardmost point. At least a forward portion of the primary groove 3*a* is a arcuate in form when viewed in a plan view, as seen in FIG. 1.

More preferably, the mid-sole 10 comprises a second generally longitudinal groove 30*b*. The second generally longitudinal groove 30*b* extends in the longitudinal direction through at least 50% of the forefoot region, the secondary groove being substantially parallel with the primary groove. The second groove 30*b* is arcuate in form when viewed in a plan view, as seen in FIG. 1. Most preferably, only the two longitudinal grooves 30*a*, 30*b* are provided.

The primary and secondary grooves may be spaced apart by a distance in the range 25 mm to 40 mm.

The depths of the transverse grooves are preferably in the range 7 mm to 12 mm.

The depths of the longitudinal grooves are preferably in the range 10 mm to 12 mm.

The thickness of the mid-sole 10 has a general taper such that the heel region C has a greater depth than the forefoot region A. Optionally, the depths of the grooves 20, 30*a*, 35, 36 may be greater in the heel region C. For example, the depths of the grooves 20, 30*a*, 35, 36 in the heel region C may be in the range 7 mm to 12 mm, with the grooves 20, 30*a*, 30*b* in the forefoot region A and arch region B having a depth in the range 5 mm to 10 mm.

Together, the longitudinal and transverse grooves 20, 30*a*, 30*b* dividing the sole into an array of lands 50. As can be seen from FIG. 2, the lands 50 are regions of the mid-sole 10 that are formed integrally with an uninterrupted substrate layer 70 of the mid-sole 10. The uninterrupted substrate layer 70 is shown by line Y in FIG. 2. The uninterrupted substrate layer 70 of the mid-sole 10 has a minimum thickness of 5 mm.

The uninterrupted substrate layer 70 is flexible and so forms a hinge allowing a degree of relative movement between the lands 50. In use of the item of footwear, this flexibility allows the mid-sole 10 to deform with the foot of the user. The inventor has discovered that the curvature of the grooves 20, 30*a*, 30*b* can be designed to achieve an improvement in the comfort of the wearer. Specifically, it is preferable if the primary longitudinal groove 30*a* is shaped to follow the path of maximum contact between a wearer's foot and the ground. A normal step commences with impact of the heel with the ground. As the foot rolls from the heel to the toes, the point of greatest contact with the ground travels along the outside of the foot.

It has been found that configuring the primary longitudinal groove 30*a* to follow the outer edge 14 of the mid-sole 10 provides improved comfort. In this way, the lands 50 forming a row along the outer edge 14 have substantially equal width. Preferably, the lands 50 forming a row along the outer edge 14 have a width (in the transverse direction) in the range 20 mm to 30 mm.

The shape of the mid-sole 10 is of a typical shape in plan view, with the edges 13, 14 being generally parallel in the heel region C. Therefore, the primary groove 30*a* extends generally centrally through at least a portion the heel region C such that the mid-sole 10 is divided into two longitudinal rows of lands 50, with each row 50 having substantially the same width in the transverse direction.

The secondary groove 30*b* begins/terminates at or near the inner edge 13 of the mid-sole 10 in the arch region B. Between the secondary groove 30*b* and the outside edge 14, the mid-sole 10 is divided into two longitudinal rows of lands 50, with each row 50 having substantially the same width in the transverse direction. Between the secondary groove 30*b* and the inside edge 13, the mid-sole 10 includes a single row of lands 50 that preferably increase in width in the transverse direction from the arch region B towards the portion of the mid-sole 10 corresponding to ball of the wearer's foot.

Whilst it is possible for the primary longitudinal groove 30*a* to terminate at the rearmost point of the mid-sole 10, it is preferable that the primary longitudinal groove 30*a* terminates in the heel region C. In such an embodiment, the heel region C of the mid-sole 10 comprises a central land 52 located generally centrally in the transverse direction. The central land 52 receives the primary impact during the heel strike. The central land 52 is preferably surrounded around its entire perimeter by a plurality of surrounding lands 53. The central land 52 is preferably circular, when viewed in a plan view as in FIG. 1, and the surrounding lands 53 are preferably arc-shaped, being separated by groove 36 which extend radially outwardly from the land 52, when viewed in plan view, as in FIG. 1. The central land 52 may have a radius of approximately 15 mm.

The central land 52 is surrounded by a groove 35, which may meet the primary groove 30*a*, and separates the central land 52 from the arc-shaped lands 53. The radially extending grooves 36 extend outwardly from the groove 35 to separate the neighbouring arc-shaped lands 53.

Since the central land 52 is subject to large forces, an insert 102 (e.g. a rigid insert) is provided in the central land 52. Similarly, inserts 103 may be provided in one or more of the arc-shaped lands 53. The inserts 102, 103 may be formed of or comprise rubber.

The mid-sole 10 includes a fowardmost region 54 within the forefoot region A. Preferably, the transverse and longitudinal grooves 20, 30*a*, 30*b* do not extend into the forwardmost region 54. This region is where the wearer pushes off in the latter part of each step and so it is preferable to provide an insert 101 is provided in the forwardmost region 54. The insert 101 may be formed of or comprise rubber. Preferably, the insert 101 is textured to provide grip.

The forwardmost region 54 may, for example, extend over the forwardmost 20% of the length of the mid-sole 10 in the longitudinal direction.

Figure 2:
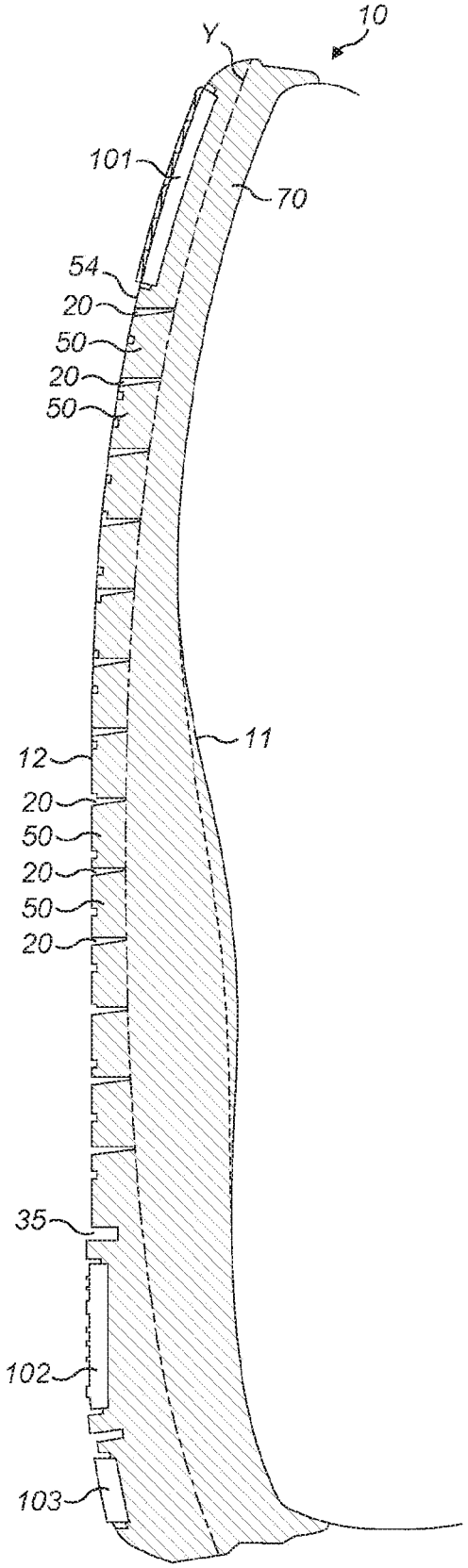
FIG. 2 shows a cross-sectional view through the mid-sole of the item of footwear of FIG. 1.

As can be seen in FIG. 2, the transverse and longitudinal grooves 20, 30*a*, 30*b* have a generally tapered cross-section (perpendicular to their lengths) such that the grooves 20, 30*a*, 30*b* are wider when they meet the second major surface 12 than at their deepest points. The width of the openings of the grooves 20, 30*a*, 30*b* at the second major surface 12 is in the range 1 mm to 3 mm.

Figure 3:
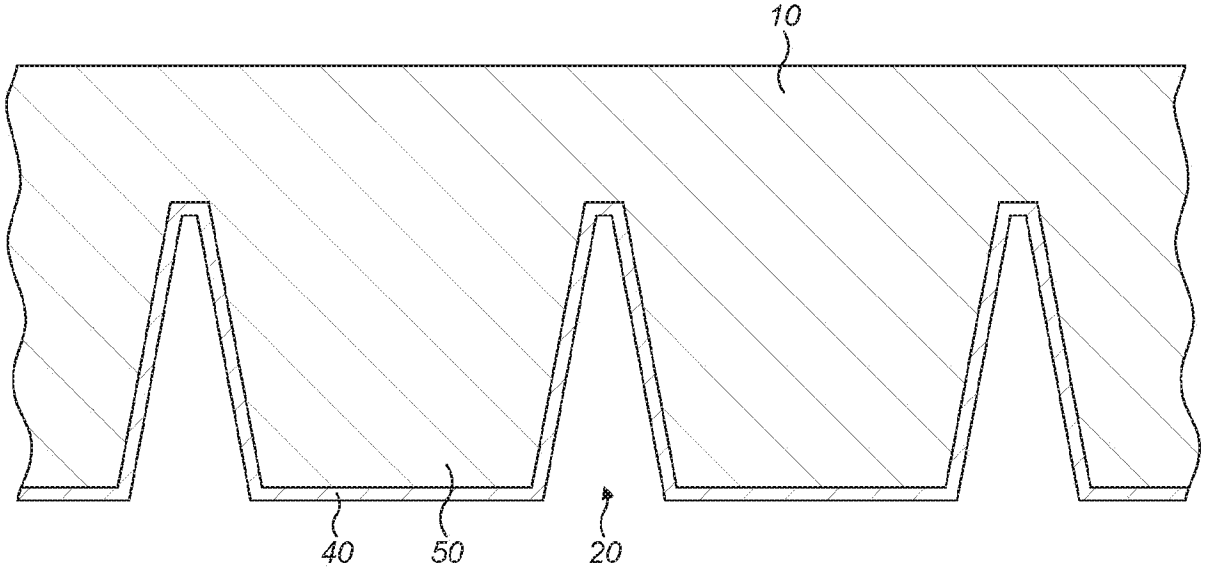
FIG. 3 shows a schematic close-up cross-section of the item of footwear.

As mentioned above, the item of footwear preferably does not comprise an outsole 40. An outsole 40 could be provided. This would be a layer formed of or comprising rubber. As shown in FIG. 3, the outsole 40 could cover the mid-sole 10 such that it extends within each groove 20, 30*a*, 30*b*, 35, 36 but does not entirely fill the groove. In other words, the outsole 40 is wrapped around the lands 50, 52, 53 of the mid-sole 10.

The invention claimed is:

1. An item of footwear comprising:

a sole having a length configured to substantially correspond in length to a foot of a wearer of the item of footwear, the sole including a mid-sole, the mid-sole having a first major surface for facing the foot of the wearer, a second major surface opposite the first major surface, the mid-sole having an inner edge corresponding to an inside of the wearer's foot and an outer edge corresponding to an outside of the wearer's foot; and the item of footwear being securably positionable to the foot of the wearer such that the first major surface of the mid-sole is configured to contact the foot of the wearer, wherein:

the mid-sole includes a heel region arranged to support a heel of the foot of the wearer of the item of footwear;

the heel region comprises a central land, surrounded around an entire perimeter of the central land by a plurality of arc-shaped lands and a plurality of radial grooves, the arc-shaped lands being defined by the plurality of radial grooves, wherein the arc-shaped lands are separated by the radial grooves extending radially outwardly from the central land;

a plurality of generally transverse grooves formed in the mid-sole and a generally longitudinal primary groove formed in the mid-sole and spaced inward from the outer edge of the sole and extending generally parallel to the outer edge of the sole over a majority of the length of the sole, the generally longitudinal primary groove extending from a radial groove of the plurality of radial grooves, the generally transverse grooves and the generally longitudinal groove intersecting to divide the mid-sole into an array of mid-sole lands; and in an arch region of the mid-sole, the generally longitudinal primary groove extends generally centrally such that the mid-sole is divided into two longitudinal rows of mid sole lands in the arch region, each mid sole land in the arch region extending in the transverse direction from the generally longitudinal primary groove to the inner edge or the outer edge and having a substantially equal size in the transverse direction.

2. The item of footwear of claim 1 wherein the plurality of generally transverse grooves are arcuate when viewed in plan view.

3. The item of footwear of claim 2 wherein the generally transverse grooves have a radius of curvature that increases with increasing distance from a rearmost point of the mid-sole.

4. The item of footwear of claim 3, wherein an insert is provided in one or more of the arc-shaped lands.

5. The item of footwear of claim 1, wherein the central land is generally circular when viewed in plan view and is surrounded by a circular groove and the plurality of radial grooves extend radially outwardly from the circular groove, when viewed in plan view, with the arc-shaped lands defined between the circular groove and the plurality of radial grooves.

6. The item of footwear of claim 5, wherein an insert is provided in the central land.

7. The item of footwear of claim 1, wherein the central land has a radius of approximately 15 mm.

8. The item of footwear of claim 1, wherein the heel region extends over the rearmost 29% to 39% of the length of the sole.

9. The item of footwear of claim 1, wherein the plurality of generally transverse grooves are spaced apart by a distance in a range of 8 mm to 14 mm.

10. The item of footwear of claim 1, wherein:

the mid-sole includes a forefoot region arranged to support a forefoot of the wearer of the item of footwear; and the mid-sole further comprises a generally longitudinal secondary groove in the forefoot region, the secondary groove being generally parallel with the primary groove.

11. The item of footwear of claim 10, wherein the forefoot region extends over the forwardmost 15% to 24% of the length of the sole.

12. The item of footwear of claim 10, wherein the secondary groove terminates at or near the inner edge of the mid-sole.

13. The item of footwear of claim 10, wherein the primary and secondary grooves are spaced apart by a distance in a range of 25 mm to 40 mm.

14. The item of footwear of claim 1, wherein:

the mid-sole includes a forwardmost region; and the grooves do not extend into the forwardmost region.

15. The item of footwear of claim 14, wherein an insert is provided in the forwardmost region.

16. The item of footwear of claim 14, wherein the forwardmost region extends over a forwardmost 20% of the length of the sole in the longitudinal direction.

17. The item of footwear of claim 1, wherein the depths of the transverse grooves are in a range of 7 mm to 12 mm.

18. The item of footwear of claim 1, wherein the depths of the longitudinal grooves are in a range of 10 mm to 12 mm.

19. The item of footwear of claim 1, wherein:

the depths of the grooves in the heel region are in a range of 7 mm to 12 mm.

20. The item of footwear of claim 1, wherein the transverse grooves and the longitudinal grooves each have a generally tapered cross-section, when viewed in a cross-section taken transversely across each groove.

21. The item of footwear of claim 1, wherein a width of openings of the grooves at the second major surface is in a range of 1 mm to 3 mm.

22. The item of footwear of claim 1, further comprising an outsole, wherein the outsole extends into each groove.

23. The item of footwear of claim 22, wherein the mid-sole has a minimum thickness of 5 mm.

* * * * *